US010522951B2

(12) United States Patent
Le

(10) Patent No.: US 10,522,951 B2
(45) Date of Patent: Dec. 31, 2019

(54) CABLE CONNECTOR

(71) Applicant: Molex, LLC, Lisle, IL (US)

(72) Inventor: Jian-Bo Le, Dongguan (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/188,518

(22) Filed: Nov. 13, 2018

(65) Prior Publication Data

US 2019/0103713 A1 Apr. 4, 2019

Related U.S. Application Data

(63) Continuation of application No. 15/673,818, filed on Aug. 10, 2017, now Pat. No. 10,128,621.

(30) Foreign Application Priority Data

Aug. 12, 2016 (CN) ..... 2016 1 0663366

(51) Int. Cl.
*H01R 13/659* (2011.01)
*H01R 13/6599* (2011.01)
(Continued)

(52) U.S. Cl.
CPC ..... *H01R 13/6599* (2013.01); *H01R 12/55* (2013.01); *H01R 13/6592* (2013.01);
(Continued)

(58) Field of Classification Search
CPC ..... H01R 13/6599
See application file for complete search history.

(56) References Cited

U.S. PATENT DOCUMENTS 3,744,128 A * 7/1973 Fisher ..... H01R 13/6599 174/75 C
4,497,533 A * 2/1985 Genova ..... H01R 13/6592 29/859

(Continued)

FOREIGN PATENT DOCUMENTS

CN 201243131 Y 5/2009
CN 201498735 U 6/2010

(Continued)

OTHER PUBLICATIONS

Office Action for Japanese Patent Application No. 2017-153317, dated Jun. 19, 2018, 7 pages (3 pages of English Translation and 4 pages of Official Copy).

*Primary Examiner* — James Harvey
(74) *Attorney, Agent, or Firm* — Molex, LLC

(57) ABSTRACT

The present disclosure discloses a cable connector, which comprises: a plurality of cables, each cable comprising a signal portion, the signal portion surrounded by an insulative member, a shielding layer surrounding the insulating layer and an insulative covering surrounding the shielding layer; a housing structure, the housing structure including a conductive bottom shell and a conductive upper shell configured to form a receiving portion; and a conductive grounding member disposed on each of the cables, the grounding member formed from a compressible material and contacts the shielding layer, wherein each cable of the plurality of cables is accommodated in the receiving portion and the grounding member of each one of the cables contacts the grounding member of an adjacent cable of the plurality of cables and at least one of the conductive shells when the conductive shells are secured together.

7 Claims, 8 Drawing Sheets

(51) Int. Cl.

| | |
|---|---|
| ***H01R 13/6592*** | (2011.01) |
| ***H01R 13/6593*** | (2011.01) |
| ***H01R 12/55*** | (2011.01) |
| ***H01R 43/033*** | (2006.01) |
| *H01R 24/60* | (2011.01) |

(52) U.S. Cl.
CPC ..... *H01R 13/6593* (2013.01); *H01R 43/033* (2013.01); *H01R 24/60* (2013.01)

(56) References Cited

U.S. PATENT DOCUMENTS

| | | | | |
|---|---|---|---|---|
| 4,929,195 | A | 5/1990 | Seidoh | |
| 5,895,292 | A | 4/1999 | Affeltranger | |
| 5,955,703 | A | 9/1999 | Daly et al. | |
| 6,152,746 | A * | 11/2000 | Brown | H01R 9/0518 439/99 |
| 6,310,286 | B1 * | 10/2001 | Troxel | H01B 9/003 174/102 R |
| 6,800,810 | B1 * | 10/2004 | Page | H01B 11/20 174/102 R |
| 7,847,188 | B2 * | 12/2010 | Liu | H02G 15/025 174/36 |
| 9,318,849 | B2 * | 4/2016 | Kobayashi | H01R 13/5205 |
| 2012/0058651 | A1 | 3/2012 | Wang et al. | |
| 2012/0322279 | A1 | 12/2012 | Kim | |
| 2015/0000953 | A1 * | 1/2015 | Kim | H01B 13/24 174/103 |
| 2015/0044909 | A1 | 2/2015 | Dunwoody et al. | |
| 2015/0188264 | A1 | 7/2015 | Yanagihara | |
| 2015/0270649 | A1 | 9/2015 | Blazek et al. | |
| 2018/0048096 | A1 * | 2/2018 | Le | H01R 13/6592 |
| 2018/0303013 | A1 * | 10/2018 | Li | H05K 9/0088 |

FOREIGN PATENT DOCUMENTS

| | | | |
|---|---|---|---|
| CN | 201708369 | U | 12/2011 |
| JP | 06-333642 | A | 12/1994 |
| JP | 2007-109684 | A | 4/2007 |
| JP | 2008-053909 | A | 3/2008 |
| JP | 2009-129865 | A | 6/2009 |

* cited by examiner

CABLE CONNECTOR

RELATED APPLICATIONS

This is a continuation application of pending U.S. patent application Ser. No. 15/673,818, filed Aug. 10, 2017, which claims priority to Chinese Application No. 201610663366.6, filed Aug. 12, 2016, both of which are incorporated herein by reference in their entirety.

TECHNICAL FIELD

The present disclosure relates to a cable connector, and more specifically relates to a cable connector improved in structure.

BACKGROUND ART

Cable connector is an important part for transmitting a signal between electronic devices, types of the cable connectors are becoming increasingly rich after years of development, various cable connectors transmit signals mostly by a metal conductor in a cable and a metal terminal in a connector. Known cable connector assembly generally comprises a connector, a cable connecting with the connector and a retainer provided between the cable and the connector, the retainer comprises a top surface horizontally arranged, connecting portions obliquely extending downwardly and outwardly respectively from two ends of the top surface and latch portions extending downwardly respectively from the connecting portions, the latch portions latch in the connector, the top surface and the connector together clamp the cable to retain the cable in the connector. The top surface of the retainer is horizontally placed in the connector, thus a width of the connector is larger in design.

In order to solve this technical problem, a cable connector 2 is disclosed in Chinese utility model patent CN201708369U, a connector 22 of the cable connector 2 is designed to have a smaller width. As shown in FIG. 1A and FIG. 1B, the cable connector 2 comprises a connector 22, a cable 21 connecting with one end of the connector 22 and a conductive ring 23 provided between the connector 22 and the cable 21 and having a regular hexagonal cross section. The connector 22 comprises: an upper shell 221 and a lower shell 222 secured and connected to the upper shell 221 and cooperating with the upper shell 221; a mating board 223 accommodated in the lower shell 222, the mating board 223 are provided with conductive pads 2231 on two surfaces of a front end and rear end, the conductive pads 2231 on the two surfaces of the front end may be electrically connected with a mating connector, the conductive pads 2231 on the two surfaces of the rear end are electrically connected with the cable 21; and a locking structure 24 mounted outside the upper shell 221. The upper shell 221 is provided with an upper receiving groove 2211, the lower shell 222 is provided with a lower receiving groove 2221, when the upper shell 221 and the lower shell 222 are assembled, the upper receiving groove 2211 and the lower receiving groove 2221 together form a pair of receiving portions 224 arranged in parallel in a horizontal direction and each having a regular hexagon cross section.

Two cables 21 illustrated in FIG. 1A and FIG. 1B each comprise multiple core wires 211, a tinfoil layer 212 surrounding the core wires 211, a shielding braid 213 surrounding the tinfoil layer 212 and an outer enclosure layer 214 surrounding the shielding braid 213. A part of the shielding braid 213 of each cable 21 is folded back over an outer surface of the outer enclosure layer 214 of each cable 21 at an end facing the connector 22, the conductive ring 23 is sheathed on the part of the shielding braid 213 folded back over the outer enclosure layer 214 of the cable 21. After the cable 21 is mounted on the connector 22, the shielding braid 213 of the cable 21 is grounded with the upper shell 221 and the lower shell 222 of the connector 22 via the conductive ring 23. The conductive ring 23 is secured in the receiving portion 224, so that the pair of the cables 21 are secured horizontally in parallel in the connector 22.

The above conductive ring 23 is a rigid metal material and is rigid in shape when the conductive ring 23 is received in the receiving portion 224, so that the regular hexagonal shape of the conductive ring 23 determines that it is impossible for the conductive ring 23 to completely attach on an outer surface of the circular cable 21 and in turn allow the shielding braid 213 folded back over the outer enclosure layer 214 to completely contact with the conductive ring 23. As can be seen from the figure, there is no complete tight contact between the conductive ring 23 and the shielding braid 213 and between the conductive ring 23 and the upper shell 221 and the lower shell 222, but there are many gaps with various size, these gaps affect grounding effect, and in turn affect high-frequency transmission rate of the cable.

SUMMARY

In view of deficiency in the prior art, an object of the present disclosure is to provide a cable connector which improves electromagnetic shielding, improves grounding effect and improves high-frequency transmission rate of the cable.

As embodied and summarized herein, in order to achieve these or other advantages and based on the object of the present disclosure, the present disclosure provides a cable connector, which comprises: at least one cable, the at least one cable comprises an insulating sheath, a shielding layer inside the insulating sheath and at least one conductive wire; a connector, the connector comprises a metal shell, the metal shell is provided with a cable receiving portion mounting the at least one cable, the at least one cable is inserted into the connector to allow the connector and the at least one conductive wire to be electrically connected, wherein the shielding layer is exposed out of the insulating sheath at an end of the at least one cable, a conductive elastomer is sheathed on the exposed shielding layer, when the cable receiving portion squeezes the at least one cable, the conductive elastomer is deformed and fills most of a gap between the cable receiving portion and the at least one cable.

In an embodiment, the exposed shielding layer at the end of the at least one cable is an outward foldback shielding layer formed by outwardly folding back the shielding layer over an exterior of the insulating sheath, the conductive elastomer is sheathed on the outward foldback shielding layer.

In an embodiment, a flexible conductive tape is wrapped around a periphery of the conductive elastomer of the at least one cable.

In an embodiment, at least two cables are integrated as a cable bundle, the flexible conductive tape is wrapped around a periphery of the conductive elastomers of the cable bundle In an embodiment, four cables are integrated as a cable bundle, the flexible conductive tape is wrapped around a periphery of the conductive elastomers of the cable bundle.

In an embodiment, the conductive elastomer is a conductive foam.

In an embodiment, the flexible conductive tape is a conductive fabric.

In an embodiment, the conductive fabric is a conductive fiber fabric or a conductive non-woven fabric.

In an embodiment, the metal shell has an upper shell and a lower shell.

In an embodiment, the upper shell and the lower shell each have a corresponding receiving half having a curved shape therein, and after the upper shell and the lower shell are assembled, the receiving halves form the cable receiving portion therein clamping the at least one cable.

One advantageous effect of the present disclosure is that shielding electromagnetic interference can be greatly improved and the high-frequency transmission rate of the cable can be improved.

Foregoing and other objects, features, aspects and advantages of the present disclosure will be apparent through the following detailed description in combination with accompanying figures.

BRIEF DESCRIPTION OF THE DRAWINGS

The present disclosure will be described in detail according to figures, in which.

DETAILED DESCRIPTION OF THE PREFERRED EMBODIMENTS

Figure 1A:
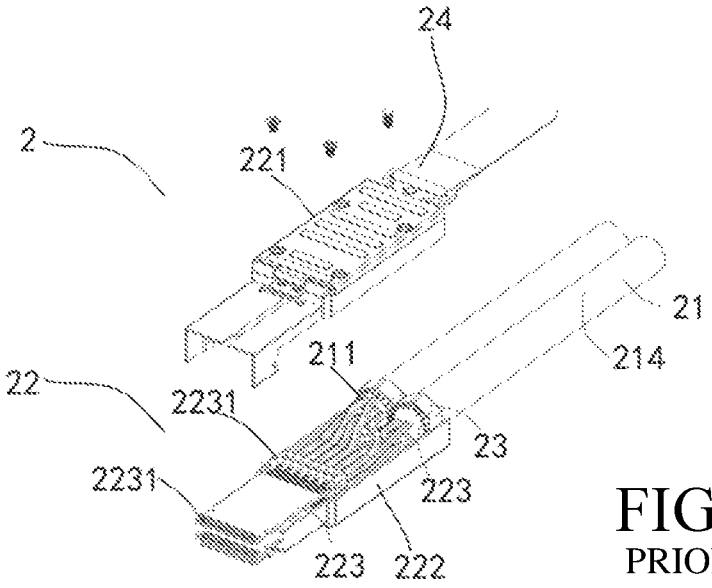
FIG. 1A PRIOR ART
FIG. 1A illustrates a perspective exploded view according to a cable connector in the prior art.
Figure 1B:
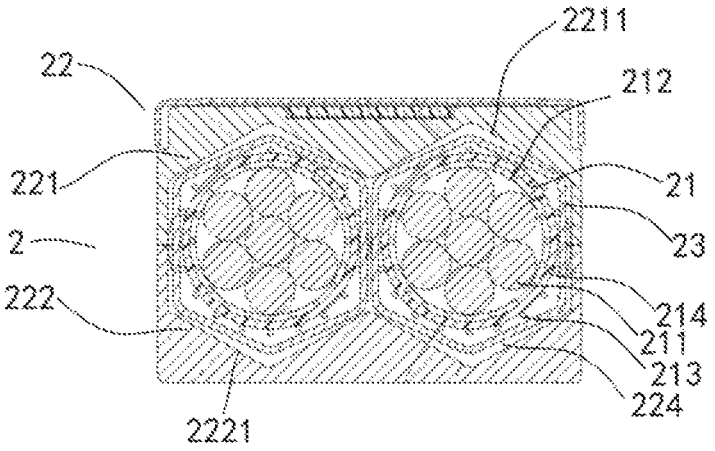
FIG. 1B PRIOR ART
FIG. 1B illustrates a cross-sectional view according to the cable connector in the prior art.

Hereinafter the present disclosure will be described in detail in combination with the accompanying figures.

While the present disclosure may be susceptible to embodiment in different forms, there is shown in the Figures, and will be described herein in detail, specific embodiments, with the understanding that the present disclosure is to be considered an exemplification of the principles of the present disclosure, and is not intended to limit the present disclosure to that as illustrated.

As such, references to a feature or aspect are intended to describe a feature of an example of the present disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the figures, representations of directions such as up, down, left, right, front and rear, used for explaining the structure and movement of the various elements of the present disclosure, are not absolute, but relative. These representations are appropriate when the elements are in the position shown in the Figures. If the description of the position of the elements changes, however, these representations are to be changed accordingly.

In FIG. 2A, FIG. 2B, FIG. 3A and FIG. 3B a cable 11 according to the present disclosure is respectively illustrated. The cable 11 according to the embodiment of the present disclosure comprises: two conductive wires 110, the two conductive wires 110 each comprise two signal wires 111 and a ground wire 112, the two signal lines 111 in each conductive wire 110 are preferably used in pairs so as to transmit a differential signal pair, for example, a positive signal and a negative signal; an inner insulating layer 113 totally enclosing the two conductive wires 110; a shielding layer 114 surrounding the inner insulating layer 113, the shielding layer 114 may be formed by, for example, a conductive metal braid; an insulating sheath 115 surrounding the shielding layer 114 from the outside. According to the present disclosure, at an end of the cable 11 for mating with a connector 12, the insulating sheath 115 is cut off by a segment to expose the shielding layer 114, the exposed shielding layer 114 is then outwardly folded back over the insulating sheath 115 at a position where the insulating sheath 115 is cut off to attach on an outer surface of the insulating sheath 115, the outward foldback shielding layer 116 outwardly folded back over the outer surface of the insulating sheath 115 extends backwardly on the outer surface of the insulating sheath 115 and then is sheathed with a conductive elastomer 117 thereon, the conductive elastomer 117 is formed of, for example, a conductive foam, the conductive foam is a conductive and shielding application material with low cost and multi-purpose application, and has advantages of compressibility (restoring force), good filling performance, good electromagnetic shielding, high conductivity, heat resistant etc., the conductive foam is used in the present disclosure especially because of good compressibility and filling performance, so as to fill a gap between the cable 11 and a cable receiving portion 130 of a metal shell, the conductive elastomer 117 is configured as a hollow cylindrical shape corresponding to the cable 11. In an embodiment, for example, a certain length of the shielding layer 114 can be exposed after a part of the insulating sheath 115 is cut off, then the conductive elastomer 117 can be directly sheathed on the exposed shielding layer 114 without outwardly folding back the shielding layer 114. In an embodiment, in addition to the above layers of the cable 11, other insulator, tinfoil layer, shielding layer or other layer may be additionally added. Each cable 11 comprises two conductive wires 110. In another embodiment, each cable 11 may only comprise one conductive wire 110 or more than two conductive wires 110.

Figure 2B:
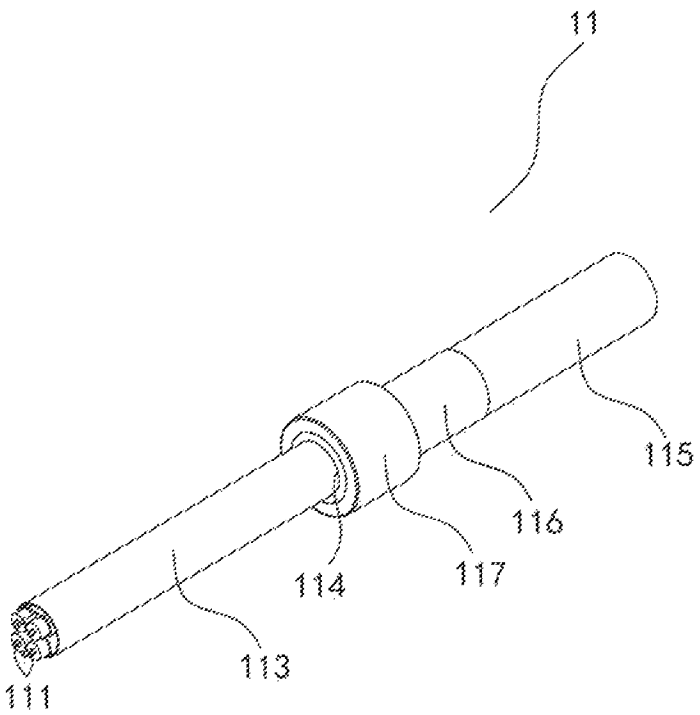
FIG. 2B illustrates a perspective view of the cable according to the present disclosure, in which the conductive elastomer is sheathed on a shielding layer of the cable.
Figure 2A:
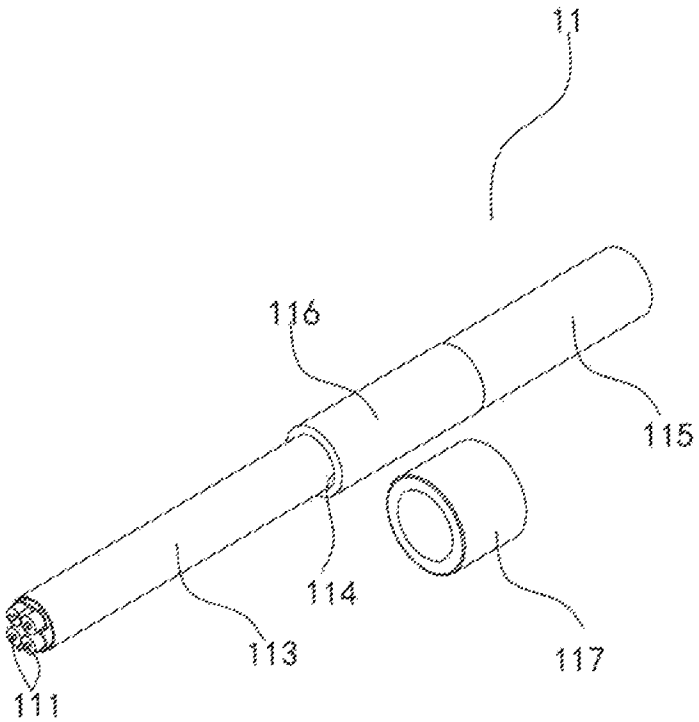
FIG. 2A illustrates a perspective view of a cable and a conductive elastomer according to the present disclosure.

In FIG. 2B, the conductive elastomer 117 with the hollow cylindrical shape is sheathed on the outward foldback shielding layer 116 of the cable 11, one end of the conductive elastomer 117 is generally aligned with the position of the insulating sheath 115 where the insulating sheath 115 is cut off and allows a longitudinal extending portion of the conductive elastomer 117 to be sheathed on the outward foldback shielding layer 116 along a direction of a longitudinal axis of the cable 11, thus the conductive elastomer 117 covers a part of outward foldback shielding layer 116 after the conductive elastomer 117 is sheathed.

Figure 3B:
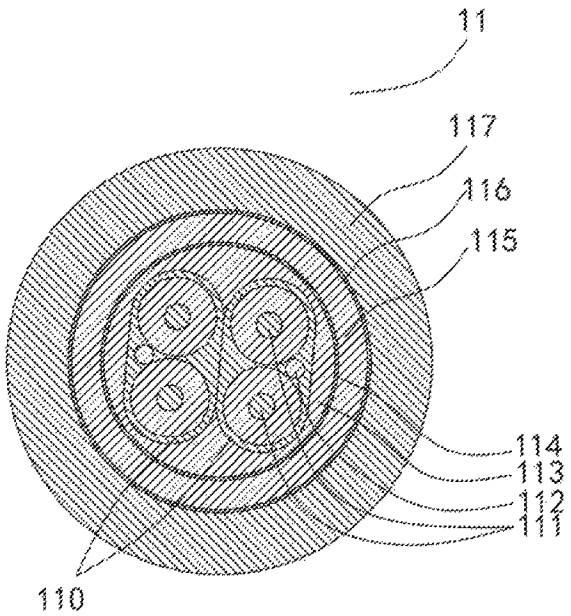
FIG. 3B illustrates a cross-sectional view of the cable taken along a line Z-Z of FIG. 3A.
Figure 3A:
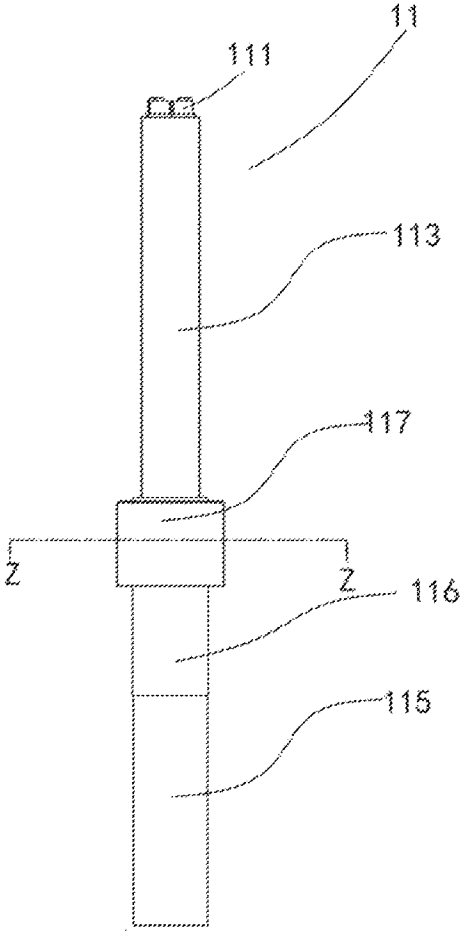
FIG. 3A illustrates a schematic view of the cable according to the present disclosure.

FIG. 3A and FIG. 3B illustrate the cable 11 according to the present disclosure, in which FIG. 3A on the left illustrates a schematic view of the cable 11 according to the present disclosure, FIG. 3B on the right illustrates a cross-sectional view of the cable 11 taken along a line Z-Z of FIG. 3A. As can be seen from FIG. 3A, the signal wire 111 is exposed from the inner insulating layer 113 on the top of the cable 11 to connect a corresponding contact, the conductive elastomer 117 is sheathed on the outward foldback shielding layer 116 outwardly folded back over the insulating sheath 115 and covers a part of the outward foldback shielding layer 116, in this figure, the position where the insulating sheath 115 is cut off is not completely aligned with an upper end of the conductive elastomer 117, but slightly protrudes out, a position of the conductive elastomer 117 arranged on the outward foldback shielding layer 116 may be varied depending on application, but preferably, the conductive elastomer 117 wholly makes an inner surface of the conductive elastomer 117 completely contact with the outward foldback shielding layer 116, thereby ensuring a reliable grounding effect.

FIG. 3B illustrates a structure of the cable 11 in detail by a cross-sectional view, an innermost layer is two conductive wires 110, the two conductive wires 110 each comprise two signal wires 111 and one ground wire 112, two differential signal pairs are transmitted in the two conductive wires 110. The inner insulating layer 113 encloses insulating enclosing portions of the conductive wires 110, then the internal shielding layer 114 surrounds the inner insulating layer 113, an insulating sheath 115 surrounds the internal shielding layer 114. The internal shielding layer 114 is outwardly folded back over the outer surface of the insulating sheath 115 at a position where the insulating sheath 115 is cut off, thereby forming an outward foldback shielding layer 116, the conductive elastomer 117 is sheathed on the outward foldback shielding layer 116. With sheathed and laminated structure of the cable, good electromagnetic shielding performance can be provided and the current can be reliably guided outwardly through the conductive elastomer 117. Moreover, each conductive wire 110 may have a multilayer of an insulator, a tinfoil layer or additional shielding layer, so as to surround the signal wires and the ground wire thereof, as shown by cross section of the conductive wire 110 in FIG. 3B.

Figure 4:
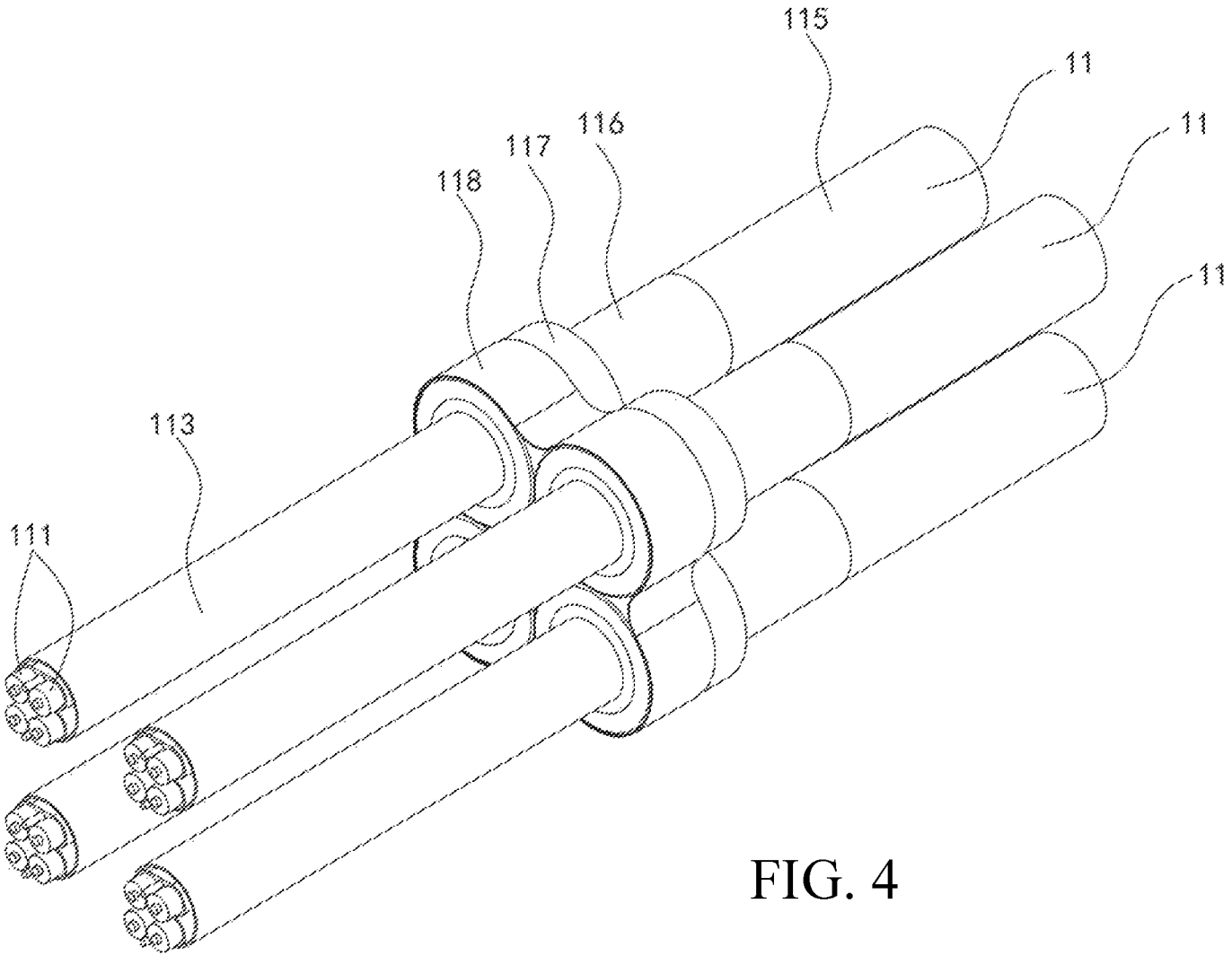
FIG. 4 illustrates a perspective view of an embodiment of a cable bundle according to the present disclosure.

FIG. 4 illustrates a perspective view of an embodiment of a cable bundle according to the present disclosure. In the embodiment, one cable bundle is integrated by the four cables 11, one flexible conductive tape 118 is wrapped around a periphery of all the conductive elastomers 117 of the cables 11. In the embodiment, the flexible conductive tape 118 may be a conductive fabric, for example, a conductive fiber fabric or a conductive non-woven fabric, with flexibility and low-impedance characteristics thereof, the flexible conductive tape 118 is used to shield electromagnetic interference and is designed for circuit-to-ground electrical conduction. The number of the cables 11 of the cable bundle may also be determined as desired. Advantageously, it is also possible to wrap the flexible conductive tape 118 only on one conductive elastomer 117 sheathed on one cable 11.

Figure 5:
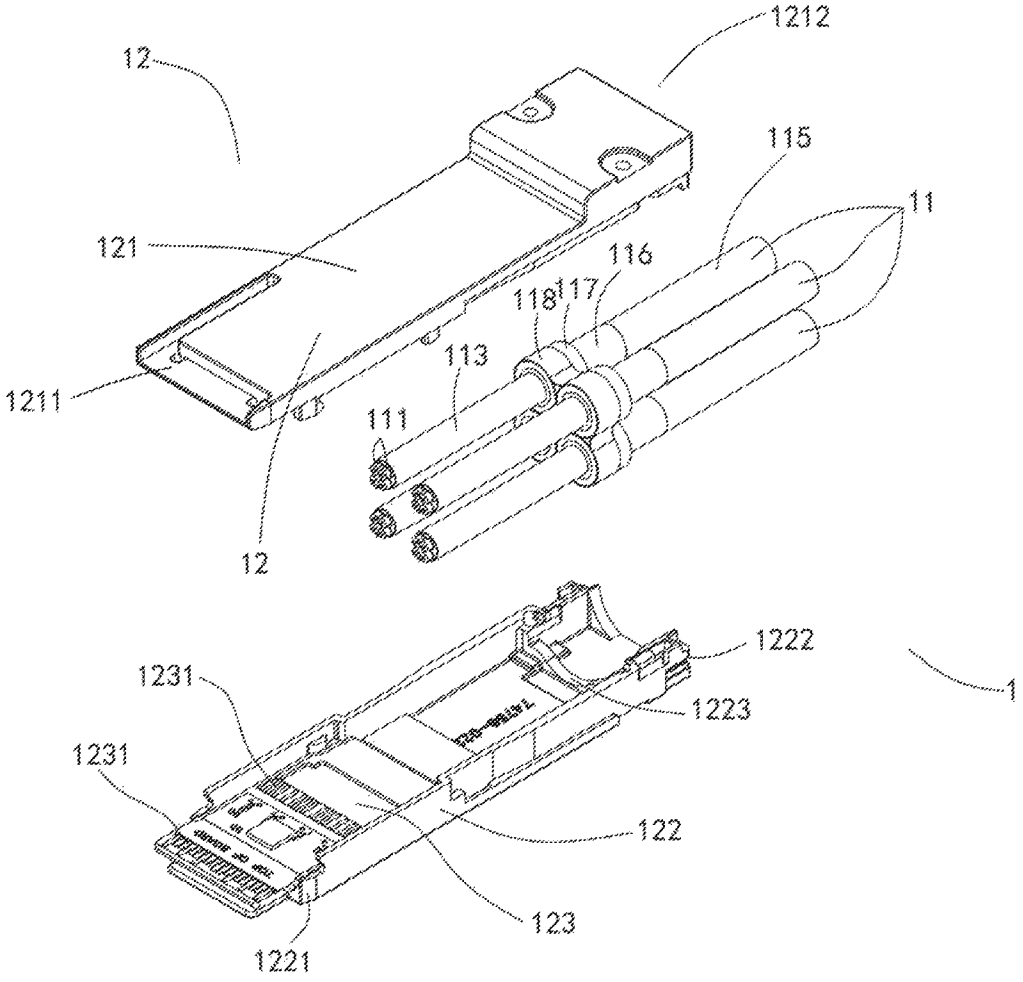
FIG. 5 illustrates a perspective exploded view of a cable connector according to the present disclosure.

FIG. 5, FIG. 6A, FIG. 6B and FIG. 6C illustrates a cable connector 1 according to the present disclosure. FIG. 5 illustrates an exploded perspective view of the cable connector 1 according to the present disclosure corresponding to FIG. 1A, in which the cable connector 1 comprises a connector 12 and the cable 11 or a cable bundle comprising at least one cable 11, the connector 12 comprises a metal shell, the metal shell has an upper shell 121 and a lower shell 122. The cable bundle comprising four cables 11 according to FIG. 4 is provided in a cable receiving portion 130 between the upper shell 121 and the lower shell 122 from between a rear end 1212 of the upper shell 121 and a rear end 1222 of the lower shell 122, signal wires 111 respectively extending out from the four cables 11 are connected, for example soldered, to conductive pads 1231 of a rear end of a mating board 123, the mating board 123 is firmly secured in a front end 1221 of the lower shell 122 of metal, and the mating board 123 together with the upper shell 121 and the lower shell 122 form a mating portion of the connector 12 after the upper shell 121 and the lower shell 122 are engaged, the conductive pad 1231 of the mating board 123 extends from the rear end of the mating board 123 to the front end of the mating board 123 and electrically contacts with a corresponding contact of a mating connector. It also can be seen from this figure, a receiving half 1223 is provided in the rear end 1222 of the lower shell 122, is configured as a curved shape and configured to correspond to a receiving half 1213 (FIG. 6B) configured in the rear end 1212 of the upper shell 121, the receiving half 1223 and the receiving half 1213 cooperatively form the cable receiving portion 130 to clamp the cable bundle after the receiving half 1223 and the receiving half 1213 are combined.

Figure 6A:
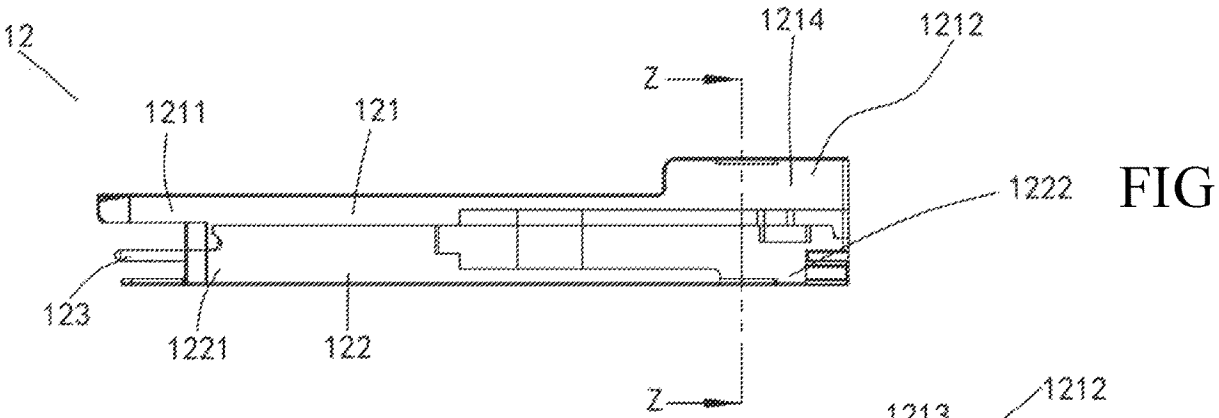
FIG. 6A illustrates a side view of the connector according to the present disclosure.
Figure 6B:
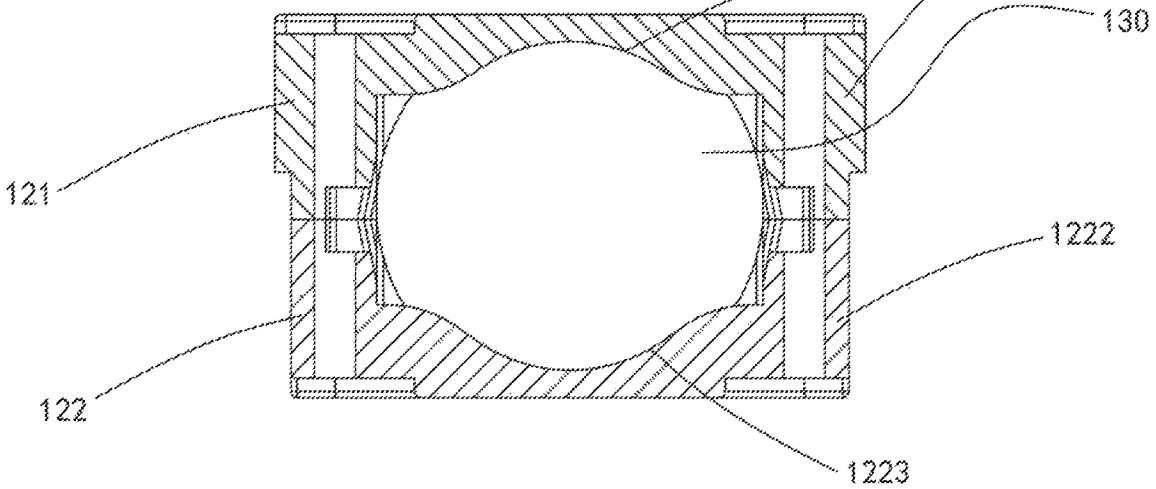
FIG. 6B illustrates a cross-sectional view of the connector taken along a line Z-Z of FIG. 6A.
Figure 6C:
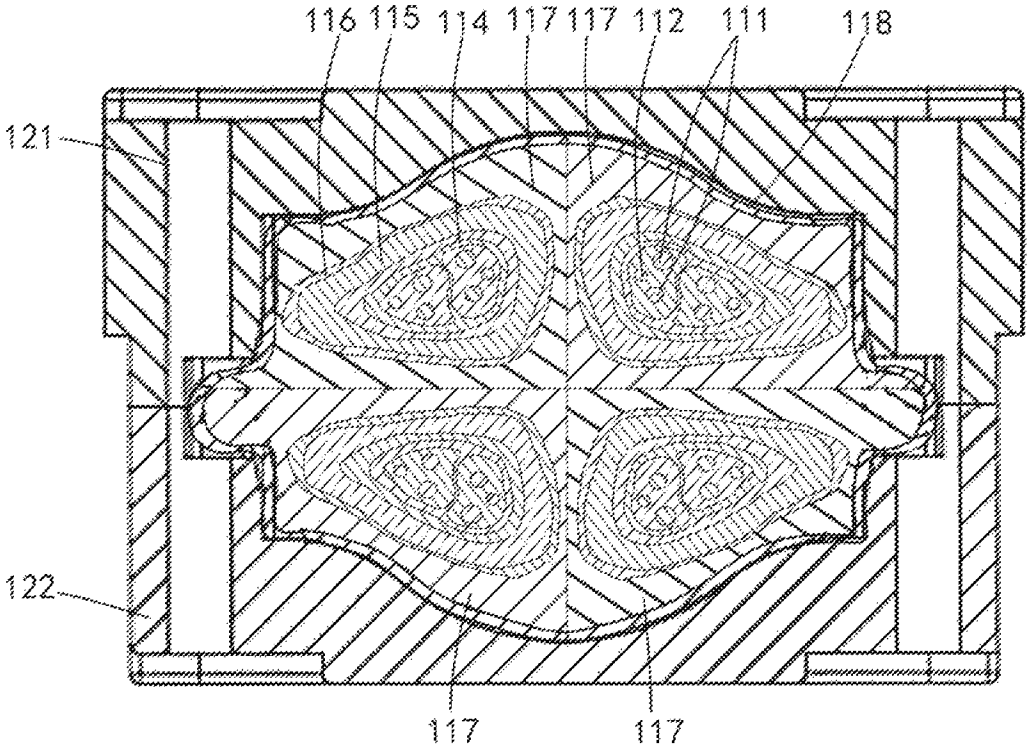
FIG. 6C illustrates a cross-sectional view of the connector taken along a line Z-Z of FIG. 6A, in which the cable bundle according to the present disclosure is schematically arranged in a metal shell of the connector.

FIG. 6A, FIG. 6B and FIG. 6C illustrate the connector 12 of the cable connector 1 in the present disclosure, the connector 12 has the upper shell 121 of metal and the lower shell 122 of metal. It can be seen from the side view of FIG. 6A that the mating board 123 extends out from the front end 1221 of the lower shell 122 of metal. The upper shell 121 is configured with a raised portion 1214 on the rear end 1212, a height of the raised portion 1214 is higher than a height of the front end 1211 so as to obtain a larger accommodating space inside the upper shell 121 which constitutes a space of the cable receiving portion 130 for clamping the cable bundle in the connector 12.

FIG. 6B illustrates a cross-sectional view through a line Z-Z passing through the rear end 1222 of the lower shell 122 and the rear end 1212 of the upper shell 121, it can be seen from this figure that a height of the rear end 1212 of the upper shell 121 is substantially equal to a height of the rear end 1222 of the lower shell 122 due to larger height of the upper shell 121 at the position of the raised portion 1214, whereby it can be seen that the receiving halves 1213, 1223 are respectively provided in the rear end 1212 of the upper shell 121 and the rear end 1222 of the lower shell 122, the two receiving halves 1213, 1223 are configured as the same curved shapes, and are combined to form a hollow cable receiving portion 130 after the upper shell 121 the lower shell 122 are assembled, the cable bundle is clamped in the cable receiving portion 130.

FIG. 6C schematically illustrates a cross-sectional view taken along a line Z-Z of FIG. 6A, it is different from FIG. 6B in that the clamped cable bundle is arranged in the cable receiving portion 130 in this figure. After the sheathed conductive elastomers 117 and the flexible conductive tape 118 surrounding the exterior of the conductive elastomers 117 of the cable bundle are placed in the position of the cable receiving portion 130, the upper shell 121 and the lower shell 122, for example, are latched and secured together by a screw, the receiving halves 1213, 1223 squeeze the conductive elastomers 117 which are original circular, the flexible conductive tape 118 wrapped around the conductive elastomers 117 and the cables 11 to be deformed by the curved shape configurations thereof, the conductive elastomers 117 and the flexible conductive tape 118 then self-fill most of the cable receiving portion 130, a gap between the cable bundle and the cable receiving portion 130 in the present disclosure is much smaller or even completely absent relative to the prior art, so the flexible conductive tape 118 and the cable receiving portion 130 occur a large area contact, thereby improving electrically contact between the cable 11 and the connector 12, in this way, the present disclosure can greatly improve the effect of shielding electromagnetic interference, improve circuit-to-ground electrical conduction and in turn improve transmission rate of the cable.

Figure 7:
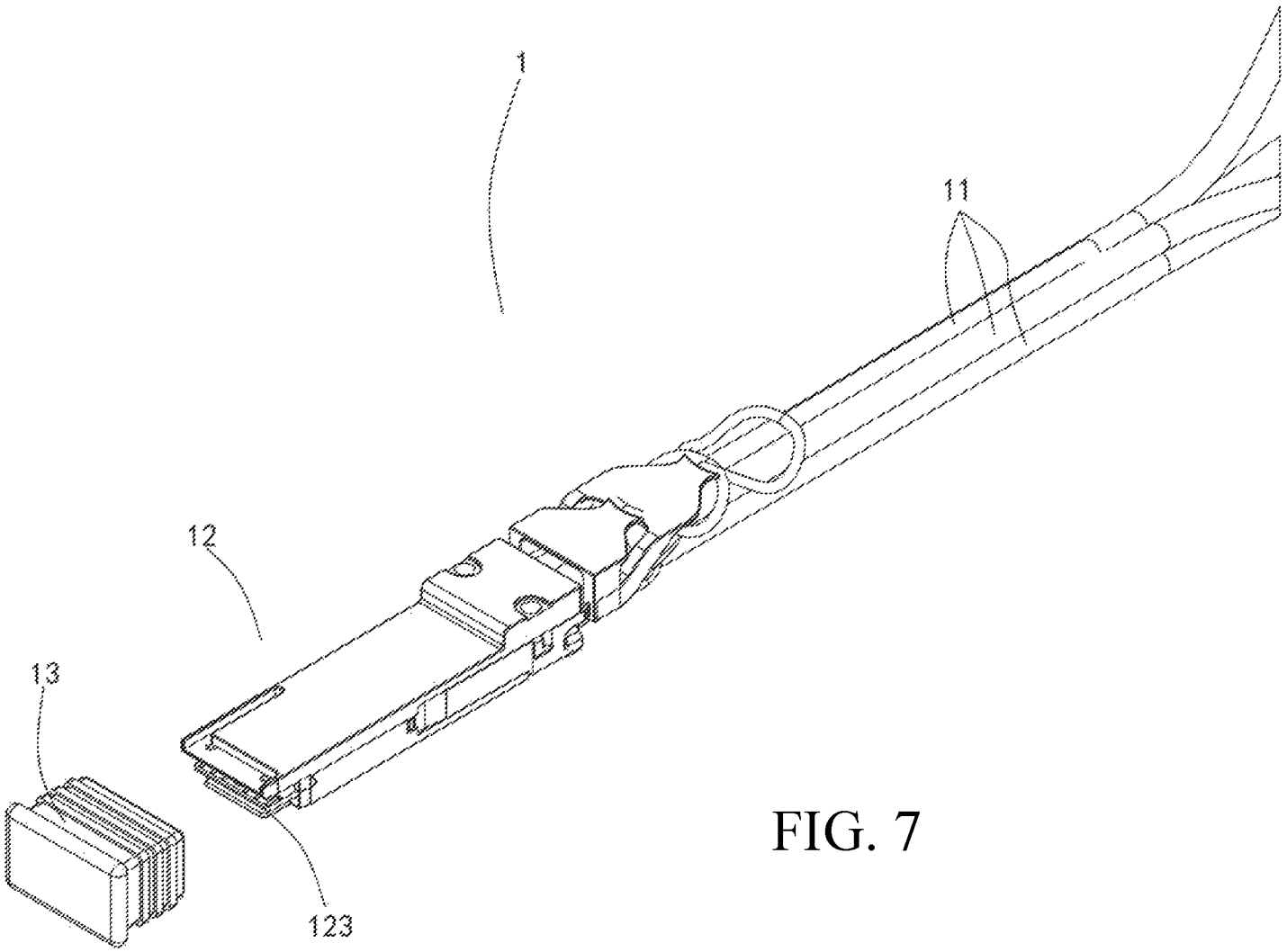
FIG. 7 illustrates a perspective view of the cable connector according to the present disclosure.

FIG. 7 briefly illustrates a perspective view of the cable connector 1 according to the present disclosure. The cable bundle comprising four cables 11 is inserted into the connector 12 from the rear, the cable connector 1 may have a protective cover 13 having a rib on the exterior of the protective cover 13, the protective cover 13 of the connector 12 may cover the mating portion of the connector 12 and protect components in the connector 12 (for example, the mating board 123 is not damaged) when the cable connector 1 is not used, in the case where the cable connector 1 is used, the protective cover 13 can be removed from the connector 12 of the cable connector 1.

The foregoing embodiments and advantages are merely exemplary and are not to be construed as limiting the present disclosure. The description herein is intended to be an example, and not to limit the scope of the claims. Various alternatives, variations and modifications will be apparent to those skilled in the art. The features, structures, methods, and other characteristics of the exemplary embodiments described herein may be combined in a variety of ways to obtain other and/or alternative exemplary embodiments.

The features of the present disclosure may be embodied in many forms without departing from the characteristics of the present disclosure, and it is to be understood that the above-described embodiments are not limited to any of the details described above, unless otherwise indicated, but are broadly construed as being within the scope of the appended claims, therefore all the modifications and variations that fall within the scope and boundary of the claims or equivalent solutions of such scope and boundary shall be encompassed by the appended claims.

What is claimed is:

1. A cable connector, comprising:

a plurality of cables, each cable comprising a signal portion, the signal portion surrounded by an insulative layer, a shielding layer surrounding the insulating layer and an insulative covering surrounding the shielding layer;

a housing structure, the housing structure including a conductive bottom shell and a conductive upper shell configured to form a receiving portion when combined;

a conductive grounding member disposed about each of the cables, the grounding member formed from a compressible material and contacts a portion of the shielding layer;

wherein each cable of the plurality of cables is accommodated in the receiving portion at which point the grounding member disposed about each one of the cables contacts the grounding member disposed about an adjacent cable of the plurality of cables and at least one of the conductive shells when the conductive shells are secured together.

2. The cable connector according to claim 1, wherein each conductive grounding member is sheathed over a respective one of the cables.

3. The cable connector according to claim 1, wherein the conductive grounding member is a conductive elastomeric material.

4. A cable grounding shield comprising:

a plurality of cables, each cable comprising a signal portion, the signal portion surrounded by an insulative layer, a shielding layer surrounding the insulating layer and an insulative covering surrounding the shielding layer;

a conductive grounding member disposed about each of the cables, the grounding member formed from a compressible material and contacts a portion of the shielding layer;

a shielding wrap, the shielding wrap surrounding a portion of each of the conductive grounding members of each of the cables wherein in combination the shielding wrap and the grounding members form the grounding shield.

5. The cable grounding shield according to claim 4, wherein the shielding wrap is a flexible conductive tape.

6. The cable grounding shield according to claim 5, wherein the flexible conductive tape is a conductive fabric.

7. The cable connector according to claim 4, wherein the shielding wrap is a conductive fiber fabric or a conductive non-woven fabric.

* * * * *